US010279358B2

(12) United States Patent
Pickens, Jr.

(10) Patent No.: US 10,279,358 B2
(45) Date of Patent: May 7, 2019

(54) WATER SPRAYING ASSEMBLY

(71) Applicant: Thomas Pickens, Jr., Palmdale, CA (US)

(72) Inventor: Thomas Pickens, Jr., Palmdale, CA (US)

( * ) Notice: Subject to any disclaimer, the term of this patent is extended or adjusted under 35 U.S.C. 154(b) by 5 days.

(21) Appl. No.: 15/451,650

(22) Filed: Mar. 7, 2017

(65) Prior Publication Data

US 2018/0257091 A1 Sep. 13, 2018

(51) Int. Cl.

| | |
|---|---|
| ***B05B 1/00*** | (2006.01) |
| ***B05B 1/20*** | (2006.01) |
| ***A63B 5/20*** | (2006.01) |
| ***A63H 23/10*** | (2006.01) |
| ***B05B 15/65*** | (2018.01) |

(52) U.S. Cl.

CPC ..... *B05B 1/205* (2013.01); *A63B 5/20* (2013.01); *A63H 23/10* (2013.01); *B05B 15/65* (2018.02)

(58) Field of Classification Search

CPC ..... A63H 23/10; A63H 37/00; A63G 21/02; A63G 21/18; A63G 31/007

USPC ..... 472/117, 128; 446/153, 156, 158, 475, 446/483

See application file for complete search history.

(56) References Cited

U.S. PATENT DOCUMENTS

| | | | | |
|---|---|---|---|---|
| D194,920 | S | 4/1963 | Darling | |
| 3,107,916 | A * | 10/1963 | Cooper | A63B 5/20 138/128 |
| 3,326,551 | A * | 6/1967 | Clarke | A63H 33/02 239/251 |
| 3,481,600 | A | 12/1969 | Lang | |
| 4,124,206 | A | 11/1978 | Price | |
| 4,498,627 | A | 2/1985 | Arginsky | |
| 4,739,985 | A | 4/1988 | Rudell et al. | |
| D337,138 | S | 7/1993 | Lopez | |
| 6,634,994 | B2 * | 10/2003 | Reid | A63B 5/20 482/81 |
| 7,175,571 | B1 | 2/2007 | Rodgers | |
| 7,727,126 | B1 | 6/2010 | Foster et al. | |
| 2005/0020414 | A1 | 1/2005 | Rudell et al. | |

FOREIGN PATENT DOCUMENTS

| | | |
|---|---|---|
| WO | WO2005011814 | 2/2005 |

* cited by examiner

*Primary Examiner* — Viet Le

(57) ABSTRACT

A water spraying assembly includes a spray unit is selectively positioned on a support surface thereby facilitating a user to stand within the spray unit. The spraying unit is fluidly coupled to a fluid source thereby facilitating the spraying unit to spray a fluid onto the user. A spin unit is rotatably coupled to the spray unit and the spin unit is selectively rotated in a first direction. The user repeatedly jumps over the spin unit when the user stands within the spray unit. A remote control is provided and the remote control is in electrical communication with the spin unit such that the remote control selectively turns the spin unit on and off.

9 Claims, 5 Drawing Sheets

WATER SPRAYING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to spraying devices and more particularly pertains to a new spraying device for combining the game of jump rope and water spraying.

BRIEF SUMMARY OF THE INVENTION

An embodiment of the disclosure meets the needs presented above by generally comprising a spray unit is selectively positioned on a support surface thereby facilitating a user to stand within the spray unit. The spraying unit is fluidly coupled to a fluid source thereby facilitating the spraying unit to spray a fluid onto the user. A spin unit is rotatably coupled to the spray unit and the spin unit is selectively rotated in a first direction. The user repeatedly jumps over the spin unit when the user stands within the spray unit. A remote control is provided and the remote control is in electrical communication with the spin unit such that the remote control selectively turns the spin unit on and off.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
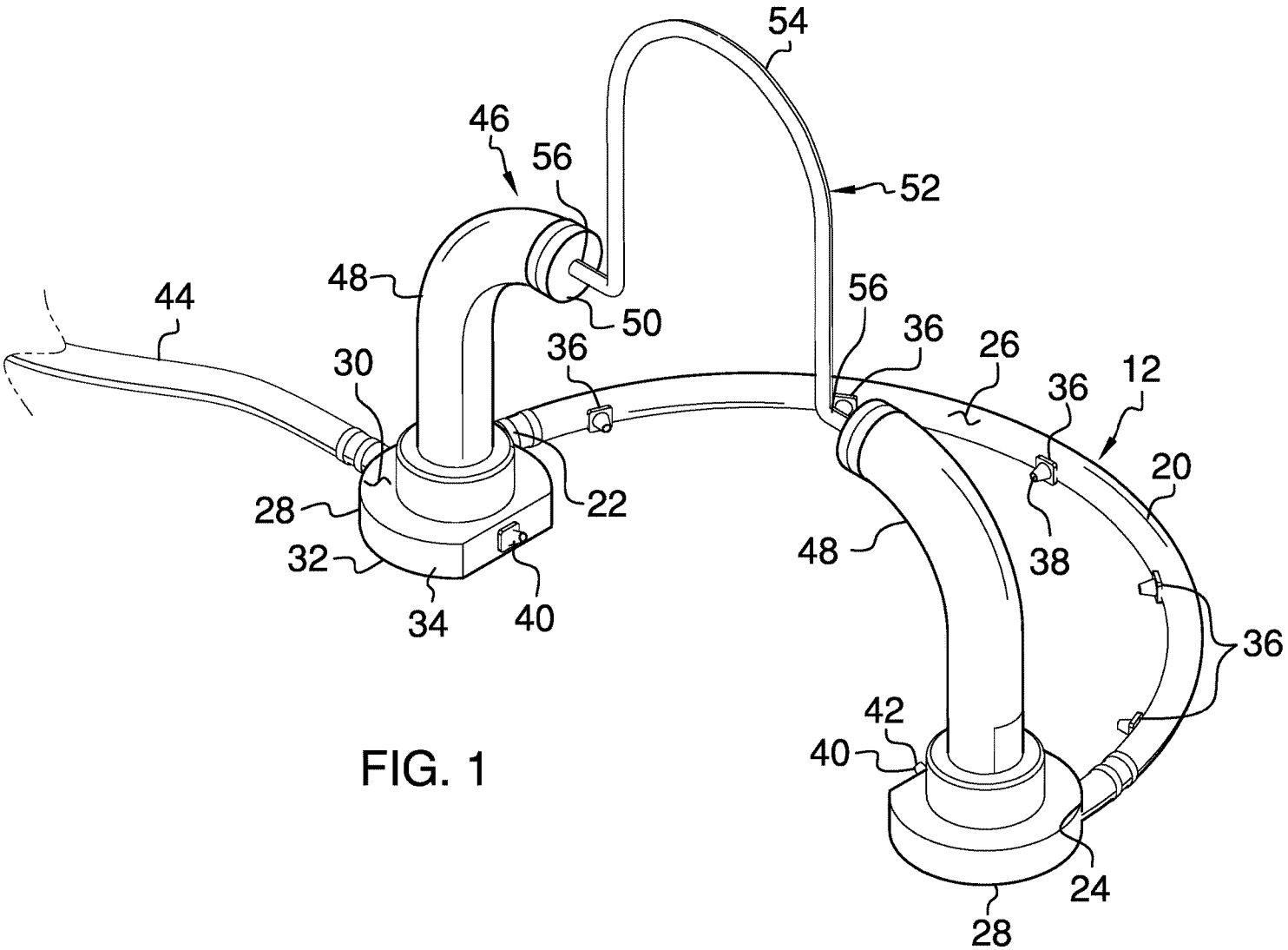
FIG. 1 is a front perspective view of a water spraying assembly according to an embodiment of the disclosure.
Figure 2:
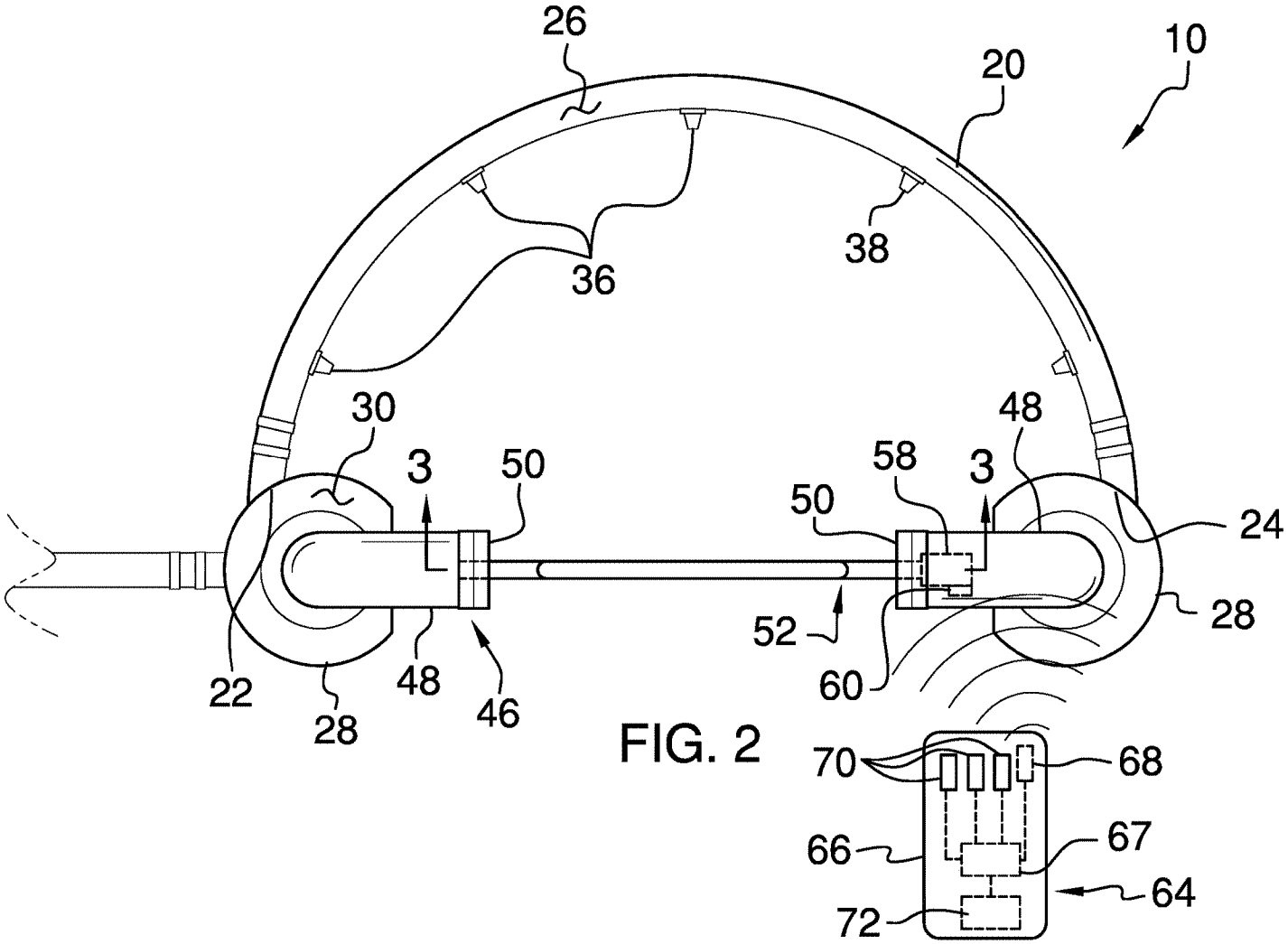
FIG. 2 is a top phantom view of an embodiment of the disclosure.
Figure 3:
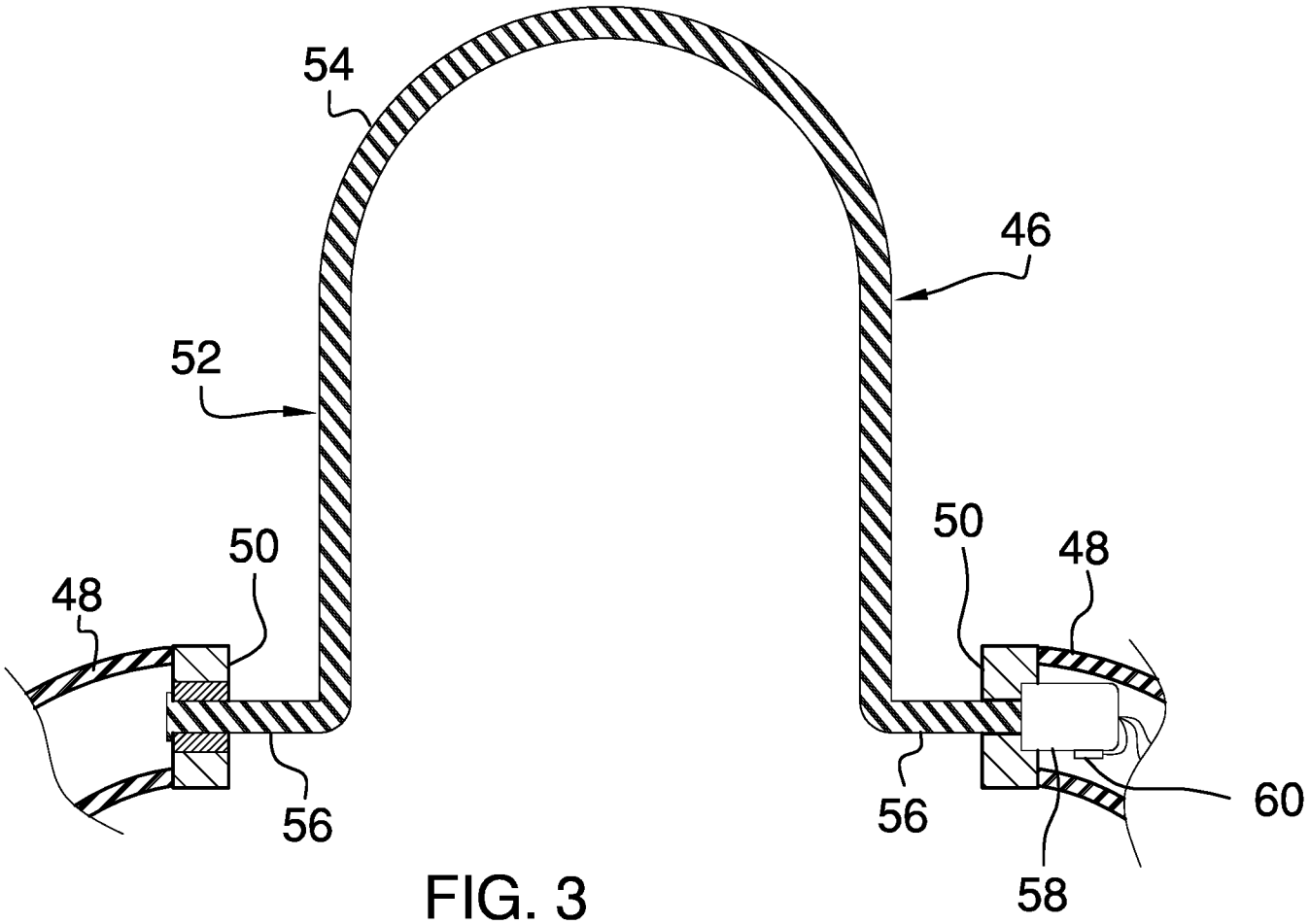
FIG. 3 is a cross sectional view taken along line 3-3 of FIG. 2 of an embodiment of the disclosure.
Figure 4:
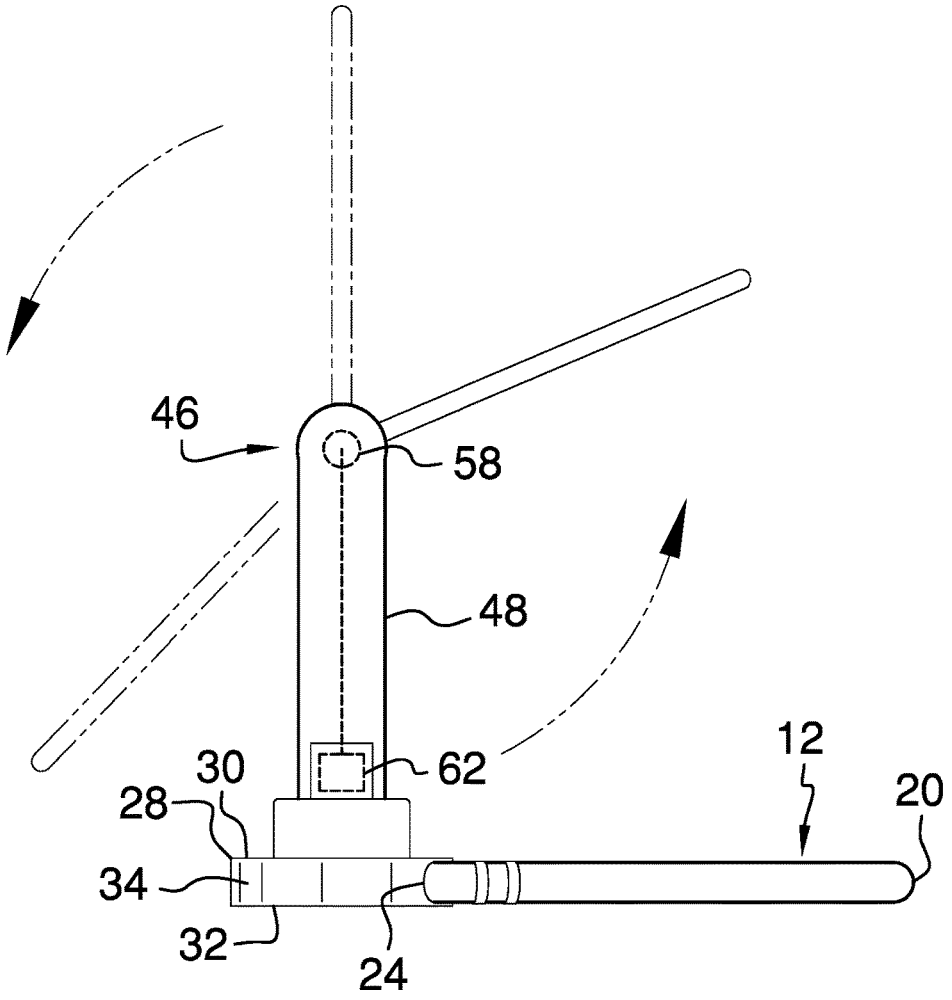
FIG. 4 is a right side view of an embodiment of the disclosure.
Figure 5:
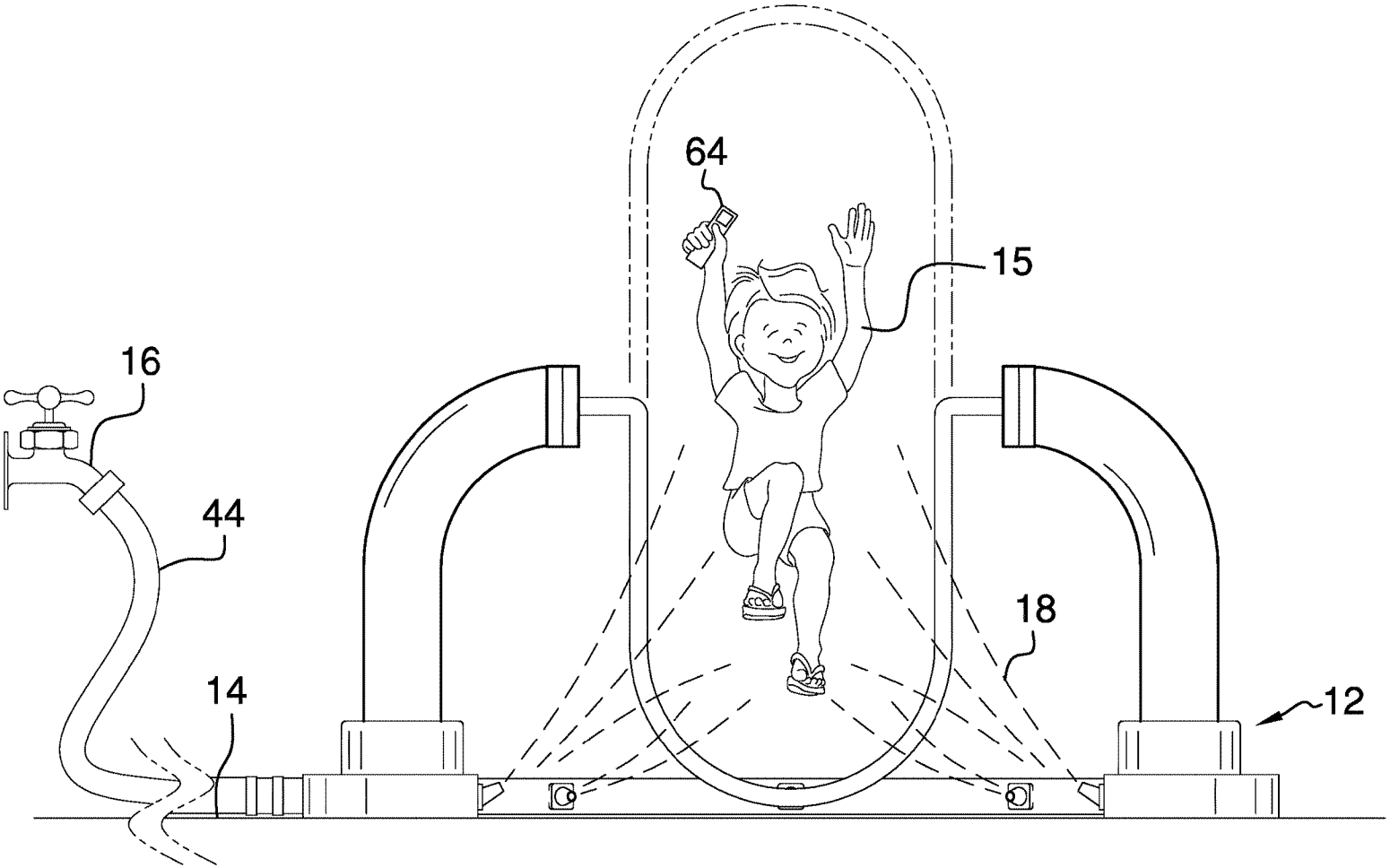
FIG. 5 is a perspective in-use view of an embodiment of the disclosure.

With reference now to the drawings, and in particular to FIGS. 1 through 5 thereof, a new spraying device embodying the principles and concepts of an embodiment of the disclosure and generally designated by the reference numeral 10 will be described.

As best illustrated in FIGS. 1 through 5, the water spraying assembly 10 generally comprises a spray unit 12. The spray unit 12 is selectively positioned on a support surface 14 thereby facilitating a user 15 to stand within the spray unit 12. The support surface 14 may be ground in a yard or the like. Moreover, the spray unit 12 is selectively and fluidly coupled to a fluid source 16 thereby facilitating the spraying unit to spray a fluid 18 onto the user 15. The fluid source 16 may be a garden hose or the like and the fluid 18 may be water.

The spray unit 12 comprises a pipe 20 that has a first end 22, a second end 24 and an outer surface 26. The pipe 20 is curved between the first end 22 and the second end 24 such that the first end 22 is aligned with the second end 24. The first end 22 may be spaced from the second end 24 a distance ranging between 1.0 meters and 1.5 meters. The pipe 20 is comprised of a fluid 18 impermeable material such as plastic or the like.

A pair of bases 28 is provided and each of the bases 28 has a top surface 30, a bottom surface 32 and a peripheral edge 34 extending therebetween. Each of the bases 28 is substantially hollow. Each of the first end 22 and the second end 24 of the pipe 20 is coupled to the peripheral edge 34 corresponding to an associated one of the bases 28. Thus, the pipe 20 forms a semi circle between the bases 28 and the user 15 selectively stands in the semi circle. The pipe 20 is in fluid communication with an interior corresponding to each of the bases 28.

A plurality of first nozzles 36 is provided and each of first nozzles 36 is fluidly coupled to the outer surface 26 of the pipe 20. Moreover, each of the first nozzles 36 is in fluid communication with an interior of the pipe 20. Each of the first nozzles 36 has a distal end 38 with respect to the pipe 20 and the distal end 38 corresponding to each of the first nozzles 36 is open to spray the fluid 18. The distal end 38 corresponding to each of the first nozzles 36 is directed toward a center of the semi circle. In this way each of the first nozzles 36 directs the fluid 18 onto the user 15 when the user 15 stands in the semi-circle. Each of the first nozzles 36 may angle upwardly between the pipe 20 and the distal end.

A plurality of second nozzles 40 is provided. Each of the second nozzles 40 is fluidly coupled to the peripheral edge 34 corresponding to an associated one of the bases 28. Moreover, each of the second nozzles 40 is in fluid communication with an interior of the associate base 28. Each of the second nozzles 40 has a distal end 42 with respect to the peripheral edge 34 and the distal end 42 corresponding to each of the second nozzles 40 is open to spray the fluid 18. Each of the second nozzles 40 is directed toward a center of the semi-circle to direct to the fluid 18 onto the user 15. Additionally, each of the second nozzles 40 may angle upwardly between the associated base 28 and the distal end 42 of the second nozzles 40.

A hose 44 is fluidly coupled to an associated one of the bases 28 such that the hose 44 is in fluid 18 communication with an interior of the associated base 28. The hose 44 is selectively and fluidly coupled to the fluid source 16. In this way the fluid 18 is delivered into each of the bases 28 and the pipe 20.

A spin unit 46 is provided and the spin unit 46 is rotatably coupled to the spray unit 12. The spin unit 46 is selectively rotated in a first direction. The user 15 repeatedly jumps over the spin unit 46 when the user 15 stands within the spray unit 12. Thus, the user 15 jumps over the spin unit 46 while the first 36 and second 40 nozzles spray the user 15 with the fluid 18.

The spin unit 46 comprises a pair of tubes 48. Each of the tubes 48 is coupled to and extends upwardly from the top surface 30 corresponding to an associated one of the bases 28. Each of the tubes 48 has a distal end 50 with respect to the associated base 28. Moreover, each of the tubes 48 is curved between the distal end 50 and the associated base 28 such that the distal end 50 corresponding to each of the tubes 48 is directed toward each other. Each of the tubes 48 may have a length ranging between 1.0 meters and 1.5 meters.

A hoop 52 is provided that has a central member 54 extending between a pair of end members 56. The central member 54 is concavely arcuate between each of the end members 56 such that the central member 54 has a U-shape. Each of the end members 56 is spaced apart from each other. Moreover, each of the end members 56 is rotatably coupled to the distal end 50 of the associated tube 48 having the central member 54 being centrally positioned between the tubes 48. The hoop 52 is selectively rotated in a first direction having the central member 54 being rotated about an axis extending through each of the end members 56 and the distal end 50 of the tubes 48. In this way the central member 54 is selectively jumped over in the convention of jump rope.

A motor 58 is provided and the motor 58 is positioned within an associated one of the tubes 48. The motor 58 is aligned with the distal end 50 of the associated tube 48 and the motor 58 is coupled to the end member 56 corresponding to the associated tube 48. The motor 58 rotates the hoop 52 when the motor 58 is turned on and the motor 58 may be an electrical motor 58 or the like. A receiver 60 is coupled to the spin unit 46 and the receiver 60 is electrically coupled to the motor 58. The receiver 60 may be a radio frequency receiver or the like. A power supply 62 is positioned within the spin unit 46 and the power supply 62 is electrically coupled to the motor 58. The power supply 62 comprises at least one battery.

A remote control 64 is provided and the remote control 64 is selectively manipulated. The remote control 64 is in electrical communication with the spin unit 46 to selectively turn the spin unit 46 on and off. The remote control 64 comprises a housing 66 that may be gripped and a processor 67 is positioned within the housing 66. The processor 67 may be an electronic processor 67 or the like.

A transmitter 68 is positioned within the housing 66 and the transmitter 68 is electrically coupled to the processor 67. The transmitter 68 is in electrical communication with the receiver 60 and the transmitter 68 may be a radio frequency transmitter 68 or the like. A plurality of buttons 70 is provided and each of the buttons 70 is coupled to the housing 66 to be manipulated. Each of the buttons 70 is electrically coupled to the transmitter 68 such that each of the buttons 70 controls operational parameters of the spin unit 46. A remote power supply 72 is positioned within the housing 66 and the remote power supply 72 is electrically coupled to the processor 67. The remote power supply 72 comprises at least one battery.

The plurality of buttons 70 may include an on button, an off button, a speed increase button and a speed decrease button. The on button may turn the motor 58 on and the off button may turn the motor 58 off. The speed increase button may increase a speed of the motor 58 up to a maximum speed. Moreover, the speed decrease button may decrease the speed of the motor 58 down to a minimum speed.

In use, each of the bases 28 and the pipe 20 are positioned on the support surface 14 and the hose is fluidly coupled to the fluid 18 source 16. Each of the first 36 and second 40 nozzles 40 sprays the fluid 18 into the semi circle when the fluid source 16 is turned on. The remote control 64 is selectively manipulated to turn the spin unit 46 on and off. Thus, the hoop 52 is rotated to facilitate the user 15 to repeatedly jump over the hoop 52 while the user 15 is sprayed with the fluid 18. The spray unit 12 may be employed while the spin unit 46 is turned on or off.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A water spraying assembly being configured to simulate a game of jump rope, said assembly comprising:

a spray unit, said spray unit being configured to be fluidly coupled to a fluid source thereby facilitating said spraying unit to spray a fluid onto the user standing within a border through a curved pipe section of said spray unit, said spray unit comprising a pipe having a first end, a second end and an outer surface, said pipe being curved between said first end and said second end to define said curved pipe section and being curved such that said first end is aligned with said second end, a plurality of first nozzles, each of first nozzles being fluidly coupled to said outer surface of said pipe such that each of said first nozzles is in fluid communication with an interior of said pipe, each of said first nozzles having a distal end with respect to said pipe, said distal end corresponding to each of said first nozzles being open wherein each of said first nozzles is configured to spray the fluid, a pair of bases, each of said bases having a top surface, a bottom surface and a peripheral edge extending therebetween, each of said bases being substantially hollow, each of said first end and said second end of said pipe being coupled to said peripheral edge corresponding to an associated one of said bases such that said pipe forms a semi circle between said bases wherein said semi circle, said pipe being in fluid communication with an interior corresponding to each of said bases, and a hose being fluidly coupled to an associated one of said bases such that said hose is in fluid communication with an interior of said associated base and said pipe, said hose being configured to be fluidly coupled to the fluid source thereby facilitating the fluid to be delivered into each of said bases and said pipe;

a spin unit being rotatably coupled to said spray unit, said spin unit being selectively rotated, said spin unit comprising:

a pair of tubes, each of said tubes being coupled to and extending upwardly from said top surface corresponding to an associated one of said bases, each of said tubes having a distal end with respect to said associated base, a hoop having a central member extending between a pair of end members, said central member being concavely arcuate between each of said end members such that said central member has a U-shape, each of said end members being rotatably coupled to said distal end of said associated tube having said central member being centrally positioned between said tubes, said hoop being selectively rotated wherein said central member is configured to be jumped over, and a motor being positioned within an associated one of said tubes, said motor being aligned with said distal end of said associated tube, said motor being coupled to said end member corresponding to said associated tube, said motor rotating said hoop when said motor is turned on; and a remote control being configured to be manipulated, said remote control being in electrical communication with said spin unit such that said remote control selectively turns said spin unit on and off.

2. The assembly according to claim 1, further comprising a plurality of second nozzles, each of said second nozzles being fluidly coupled to said peripheral edge corresponding to an associated one of said bases such that each of said second nozzles is in fluid communication with an interior of said associate base, each of said second nozzles having a distal end with respect to said peripheral edge, said distal end corresponding to each of said second nozzles being open wherein each of said second nozzles is configured to spray the fluid.

3. The assembly according to claim 1, wherein said spin unit comprises a pair of tubes, each of said tubes being coupled to and extending upwardly from said top surface corresponding to an associated one of said bases, each of said tubes having a distal end with respect to said associated base, each of said tubes being curved between said distal end and said associated base such that said distal end corresponding to each of said tubes is directed toward each other.

4. The assembly according to claim 1, further comprising a receiver being coupled to said spin unit, said receiver being electrically coupled to said motor.

5. The assembly according to claim 1, further comprising a power supply being positioned within said spin unit, said power supply being electrically coupled to said motor, said power supply comprising at least one battery.

6. The assembly according to claim 1, wherein said remote control comprises:

a housing being configured to be gripped; and a processor being positioned within said housing.

7. The assembly according to claim 6, further comprising:

a receiver;

a transmitter being positioned within said housing, said transmitter being electrically coupled to said processor, said transmitter being in electrical communication with said receiver; and a plurality of buttons being coupled to said housing wherein each of said buttons is configured to be manipulated, each of said buttons being electrically coupled to said transmitter such that each of said buttons controls operational parameters of said spin unit.

8. The assembly according to claim 7, further comprising a remote power supply being positioned within said housing, said remote power supply being electrically coupled to said processor, said remote power supply comprising at least one battery.

9. A water spraying assembly being configured to simulate a game of jump rope, said assembly comprising:

a spray unit being configured to be positioned on a support surface thereby facilitating a user to stand within said spray unit, said spraying unit being configured to be fluidly coupled to a fluid source thereby facilitating said spraying unit to spray a fluid onto the user, said spray unit comprising:

a pipe having a first end, a second end and an outer surface, said pipe being curved between said first end and said second end such that said first end is aligned with said second end, a pair of bases, each of said bases having a top surface, a bottom surface and a peripheral edge extending therebetween, each of said bases being substantially hollow, each of said first end and said second end of said pipe being coupled to said peripheral edge corresponding to an associated one of said bases such that said pipe forms a semi circle between said bases wherein said semi circle is configured to have a user stand therein, said pipe being in fluid communication with an interior corresponding to each of said bases, a plurality of first nozzles, each of first nozzles being fluidly coupled to said outer surface of said pipe such that each of said first nozzles is in fluid communication with an interior of said pipe, each of said first nozzles having a distal end with respect to said pipe, said distal end corresponding to each of said first nozzles being open wherein each of said first nozzles is configured to spray the fluid, said distal end corresponding to each of said first nozzles being directed toward a center of said semi circle wherein each of said first nozzles is configured to direct the fluid onto the user, a plurality of second nozzles, each of said second nozzles being fluidly coupled to said peripheral edge corresponding to an associated one of said bases such that each of said second nozzles is in fluid communication with an interior of said associate base, each of said second nozzles having a distal end with respect to said peripheral edge, said distal end corresponding to each of said second nozzles being open wherein each of said second nozzles is configured to spray the fluid, each of said second nozzles being directed toward a center of said semi-circle wherein each of said second nozzles is configured to direct to the fluid into the user, and a hose being fluidly coupled to an associated one of said bases such that said hose is in fluid communication with an interior of said associated base, said hose being configured to be fluidly coupled to the fluid source thereby facilitating the fluid to be delivered into each of said bases and said pipe;

a spin unit being rotatably coupled to said spray unit, said spin unit being selectively rotated wherein said spin unit is configured to have the user repeatedly jump over said spin unit when the user stands within said spray unit, said spin unit comprising:

a pair of tubes, each of said tubes being coupled to and extending upwardly from said top surface corresponding to an associated one of said bases, each of said tubes having a distal end with respect to said associated base, each of said tubes being curved between said distal end and said associated base such that said distal end corresponding to each of said tubes is directed toward each other, a hoop having a central member extending between a pair of end members, said central member being concavely arcuate between each of said end members such that said central member has a U-shape, each of said end members being spaced apart from each other, each of said end members being rotatably coupled to said distal end of said associated tube having said central member being centrally positioned between said tubes, said hoop being selectively rotated in a first direction having said central member being rotated about an axis extending through each of said end members and said distal end of said tubes wherein said central member is configured to be selectively jumped over in the convention of jump rope, a motor being positioned within an associated one of said tubes, said motor being aligned with said distal end of said associated tube, said motor being coupled to said end member corresponding to said associated tube, said motor rotating said hoop when said motor is turned on, a receiver being coupled to said spin unit, said receiver being electrically coupled to said motor, and a power supply being positioned within said spin unit, said power supply being electrically coupled to said motor, said power supply comprising at least one battery; and a remote control being configured to be manipulated, said remote control being in electrical communication with said spin unit such that said remote control selectively turns said spin unit on and off, said remote control comprising:

a housing being configured to be gripped, a processor being positioned within said housing, a transmitter being positioned within said housing, said transmitter being electrically coupled to said processor, said transmitter being in electrical communication with said receiver, a plurality of buttons being coupled to said housing wherein each of said buttons is configured to be manipulated, each of said buttons being electrically coupled to said transmitter such that each of said buttons controls operational parameters of said spin unit, and a remote power supply being positioned within said housing, said remote power supply being electrically coupled to said processor, said remote power supply comprising at least one battery.

* * * * *